US005468389A

United States Patent [19]

Keller

[11] Patent Number: 5,468,389

[45] Date of Patent: Nov. 21, 1995

[54] DOUBLE-ACTING PUSHER CENTRIFUGE

[75] Inventor: Niklaus Keller, Effretikon, Switzerland

[73] Assignee: Sulzer-Escher Wysse AG, Zurich, Switzerland

[21] Appl. No.: 258,043

[22] Filed: Jun. 10, 1994

[30] Foreign Application Priority Data

Jul. 22, 1993 [EP] European Pat. Off. ..... 93810529

[51] Int. Cl.[6] ..... B04B 3/02

[52] U.S. Cl. ..... 210/360.2; 210/374; 210/380.3; 494/58

[58] Field of Search ..... 210/360.2, 374, 210/376, 380.3, 394, 512.1; 494/56, 58

[56] References Cited

U.S. PATENT DOCUMENTS 3,563,387 2/1971 Okvist .
4,493,769 1/1985 Paschedag et al. ..... 210/374

FOREIGN PATENT DOCUMENTS 0068095 1/1983 European Pat. Off. .
595612 4/1934 Germany .
1114149 9/1961 Germany .
1949641 4/1971 Germany .

*Primary Examiner*—Robert A. Dawson
*Assistant Examiner*—David Reifsnyder
*Attorney, Agent, or Firm*—Townsend and Townsend and Crew

[57] ABSTRACT

The application discloses double-acting pusher centrifuges comprising a rotatable sieve drum (6) which carries out separation of a mixture (17) into liquid and solid matter portion (40) in the form of filter cakes (14, 15). A centrally located pusher floor device, movable to-and-fro along the axis (9) of the sieve drum (6), pushes out alternately to one side and the other by its outer annular region the filter cake (14) deposited since the last clearing of the drum region. The pusher floor is provided at the height of the filter cake with a plurality of axial throughflow openings (12), which are fed through associated radial feeding openings (13) with a mixture. Deflection into the axial throughflow openings takes place automatically according to the resistance at the outlet which is large on the pushing-out side against the filter cake (14) to be moved, while on the opposite side behind the retreating pusher floor an empty space (16) is created into which the mixture can flow. The distribution is performed automatically, while, due to the high peripheral velocity there is enough pressure in the throughflow openings (12) to equalize nuances in the level on both sides.

10 Claims, 5 Drawing Sheets

DOUBLE-ACTING PUSHER CENTRIFUGE

BACKGROUND OF THE INVENTION

The invention relates to a double-acting pusher centrifuge comprising a rotatable sieve drum to obtain separation of a mixture into liquid and solid matter portion in the form of filter cakes, a centrally located pusher floor device that is movable to-and-fro along the axis of the sieve drum to push out alternately to one and the other side by an outer annular region the filter cakes, and a central feeding unit to feed fresh mixture in empty spaces formed behind the retreating outer annular region.

Double-acting pusher centrifuges have the advantage that during the pushing-out movement performed by the pusher floor device in one direction in order to push out the filter cake, an empty space is created at the sieve drum on the rear side of the pusher floor into which fresh mixture for filtering may be fed. In the case of correct reversal of the feeding with mixture to the relevant opposite side of the pusher floor device, feeding may proceed continuously. EP 0 068 095 shows double-acting pusher centrifuges having on the pusher floor device a central throughhole, the edge of which is used as a control edge to automatically direct the mixture from a stationary radial feeding means to the front or rear side in dependence on the position of the pusher floor. On both sides is a friction plate connected to the pusher floor proper to form a rotating annular space in which the mixture is accelerated towards the sieve drum. It is essential to ensure that the same amount of solid matter is admitted to the two drum halves before and behind the pusher floor. The axial position of the radial feeding means must therefore be accurately adjusted and the position must be found experimentally by measurement of the two streams of solid matter amounts. In the case of products causing wear, long-term changes in the geometry of the feeding pipe may result in uneven distribution. Furthermore, variations in the amount fed is passed on as uneven distribution. Such variations in the amount may be theoretically reduced by increased throttling at the outlet of the radial feeding means. However, the necessary feed height must be available for such throttling and there is a danger of back damming and blockage, in the case of reduced outlet opening.

SUMMARY OF THE INVENTION

The aim of the invention is to simplify the distribution of mixture in double-acting pusher centrifuges. This aim is achieved by providing a plurality of axial throughflow openings on both sides in the outer annular region of the pusher floor device, which may be fed from the center through associated radial feeding openings in the pusher floor device and which transfer the mixture on/to both sides in axial direction to guide it, against the pushing-out movement of the pusher floor device to that side of the drum, at which at that moment the pusher floor moves away from the filter cake.

The invention has the advantage that the axial distribution of the mixture takes place directly in the pressure field on the surface of the sieve drum through the axial throughflow openings. Thus the radially entering mixture is distributed to the side which moves away from the filter cake corresponding to the outlet openings differently limited by the filter cake. The state of the filter cake on the pusher floor automatically controls the distribution of the mixture, while the individual radial feeding of a plurality of axial throughflow openings ensures that the mixture in the throughflow openings has the same peripheral velocities and pressures. The radial feeding openings branch from an annular space which, in spite of its axial movement, may be easily supplied with mixture by the central feeding unit. An axially situated opening in the pusher floor device may be used exclusively for the flow of rinsing and washing liquid therethrough when, e.g. a support pipe extends through the central feeding device and at the rear region has a deflector. This produces a simple, unblocked feeding system and more space for product washing on the rear side of the drum. There is enough space there for an annular channel, which runs together with the pusher floor, but is axially displaceable with respect to it and which deflects and accelerates the rinsing and washing liquid to the filter cake.

In order to effectively axially push out the filter cake and to feed through axial throughflow openings in the pusher floor, annular gap sections and intermediate elements must alternate. According to the shape of the common annular space from which the radial feeding openings branch off, the axial throughflow openings in the outer annular region of the pusher floor may be made very differently. In the case of a double-walled pusher floor both walls of which form the common annular space, spacers may be used which carry out distribution to the axial throughflow openings. When the axial throughflow openings are open towards the periphery, the intermediate elements must be wider to achieve the same pushing-out effect on the filter cake as an outer annular surface with a closed peripheral band. In order to make the pushing-out effect on the filter cake adaptable and to make the axial outlet height for the mixture from the axial throughflow openings with respect to the inner jacket surface of the sieve drum, wearing rings may be provided in the outer annular region.

Another possibility for providing a double-walled pusher floor comprises in the provision of the axial throughflow openings in the pusher floor proper and to mill in their radial feeding openings in the form of channels, while a subsequently applied cover covers the channels and at the same time forms the annular space common to them. Such, e.g. milled in, channels have the advantage that they may be offset forward in the direction of rotation with respect to the center of an annular gap section in order to admit the mixture more uniformly to the axial throughflow opening over its portion on the periphery.

BRIEF DESCRIPTION OF THE DRAWINGS

The invention will now be explained, by way of example, with the help of embodiments. In the drawings.

DESCRIPTION OF THE PREFERRED EMBODIMENTS

In the Figures are shown double-acting pusher centrifuges having a rotatable sieve drum which separate a mixture into liquid and solid matter portion in the form of a filter cake. A centrally arranged pusher floor, which is movable to-and-fro along the axis of a sieve drum, pushes out, by its outer annular region, alternately to one side and the other, the filter cake formed since the last clearing of the drum region. The pusher floor has at the height of the filter cake, a plurality of axial throughflow openings to which is fed a mixture, via associated radial feeding openings. The deflection into the axial throughflow openings takes place automatically according to the resistance at the outlet, which is large on the pushing-out side against the filter cake to be moved, while on the opposite side, behind the retreating pusher floor, an empty space is created into which the mixture can flow. The distribution proceeds automatically while, due to the high peripheral velocity, there is sufficient pressure in the throughflow openings to equalize nuances in the level on both sides.

Figure 1:
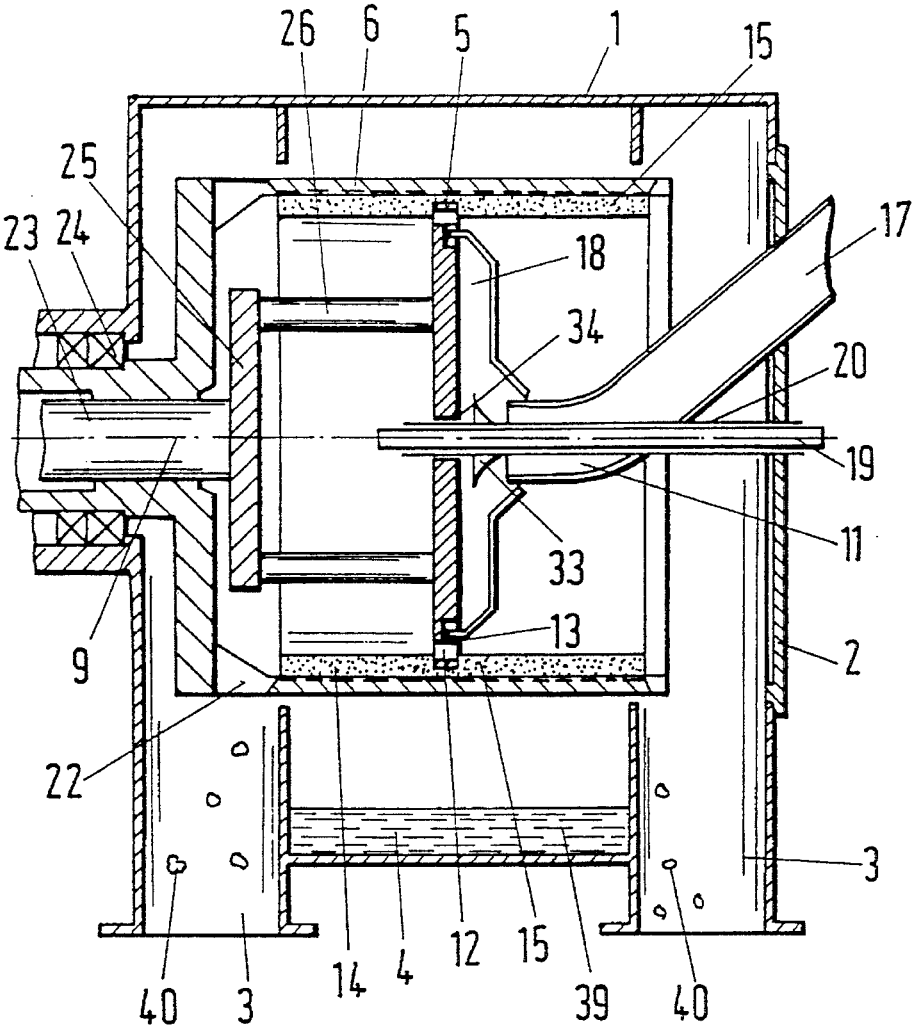
FIG. 1 shows diagrammatically a longitudinal section through a double-acting pusher centrifuge.

In FIG. 1 a sieve drum 6 is mounted at one side, via bearings 24, in a housing 1, which in its central region captures, into a housing 4 for filtrate, liquid 39 centrifuged out by the sieve drum 6, while the filter cakes 14, 15 are, by an axially oscillating pusher floor device 5, respectively pushed along the surface of the drum jacket out into a corresponding housing 3 for solid matter. On the bearing side, a plurality of outlet openings 22 for the rear filter cake 14 is made in the sieve drum. The pusher floor device 5 itself is, via rods 26 and a pusher hub 25, connected to a piston rod 23, which in turn is mounted to be axially displaceable in the axis 9 of the sieve drum to perform during rotation with the sieve drum 6 an axially oscillating movement, which is by the pusher floor proper transmitted at its periphery onto the filter cakes 14, 15. The housing 1 is closed by a housing cover 2. On the housing cover is a mixture 17 provided by a feeding unit 11 in the form of a pipe through which passes at its outlet a coaxial support pipe 20; the support pipe carries a deflector 33 which deflects the mixture 17 in a radial direction. The support pipe 20 extends through a central opening 34 in the pusher floor device 5 into the rear space of the sieve drum 6 and enables feeding of rinsing and/or washing liquid 21 into the rear space, through one or more pipes 19 situated in it.

Figure 4:
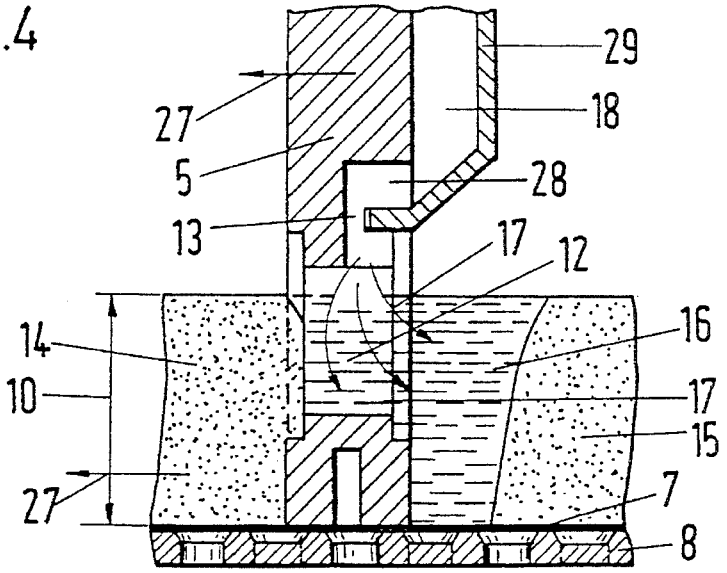
FIG. 4 shows an enlarged cut-out of the pusher floor proper from FIG. 3 at its periphery at the sieve drum.
Figure 3:
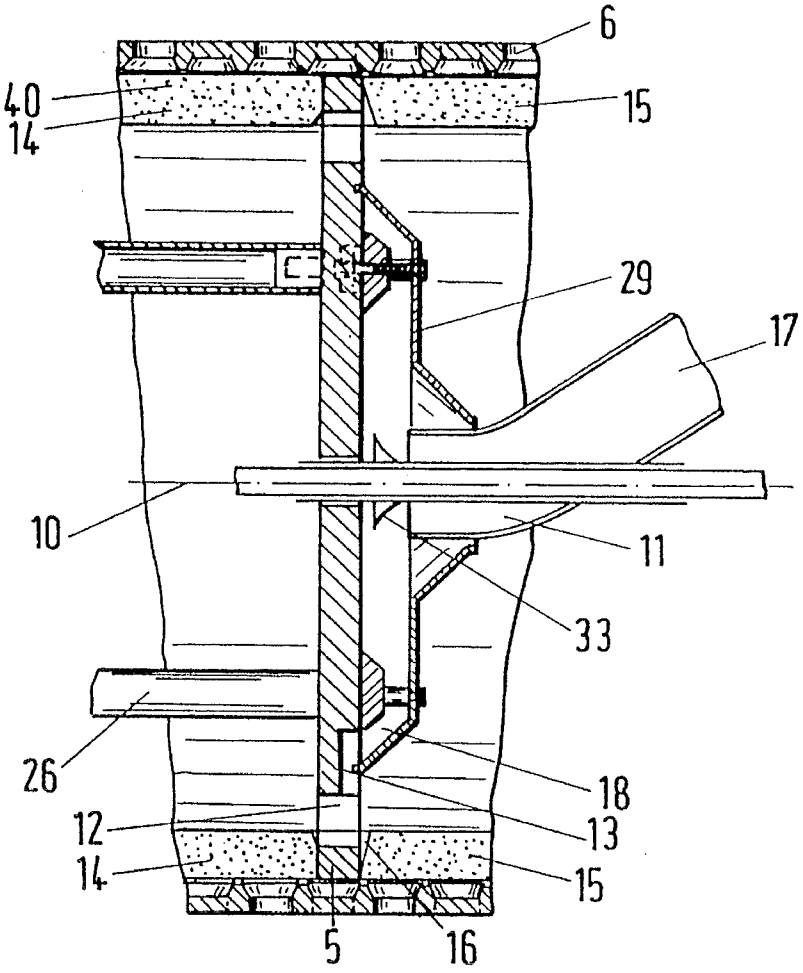
FIG. 3 shows diagrammatically a longitudinal section through a pusher floor device according to FIG. 2 in which is provided a cover to create an annular space and to cover the pockets.
Figure 2:
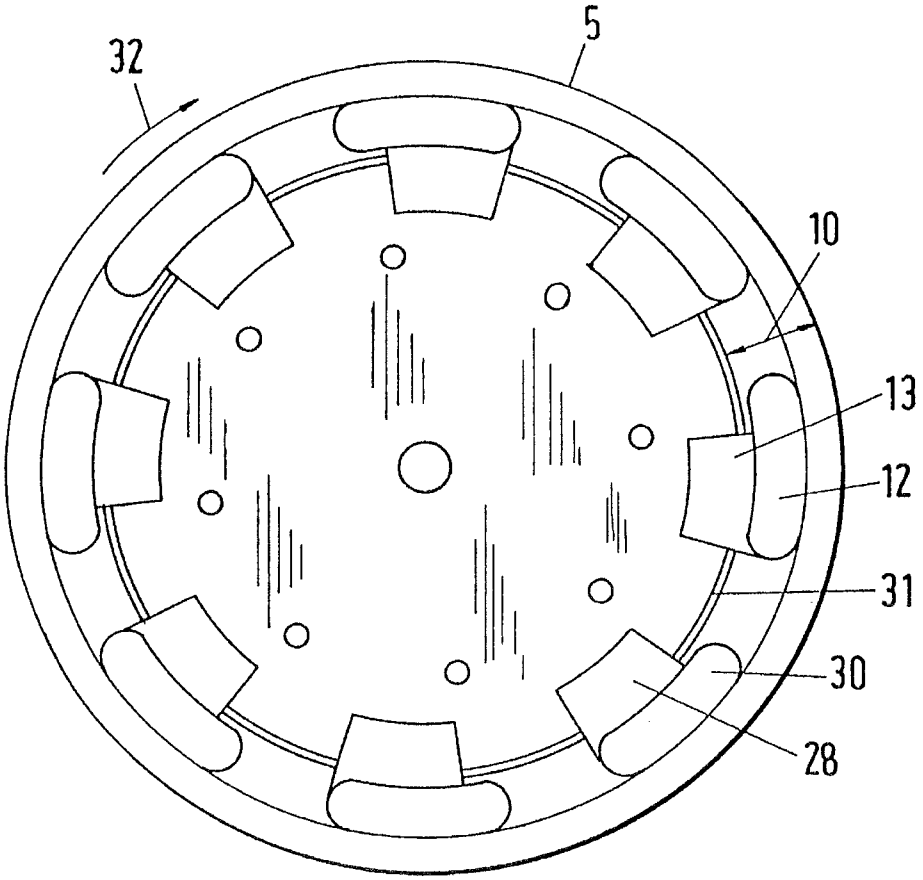
FIG. 2 shows diagrammatically a front elevation of a pusher floor device having axial throughflow openings and radial feeding openings in the form of pockets.

In FIGS. 2, 3 and 4 is shown an embodiment of the pusher floor device 5 in which a cover 29 positioned on the front side defines an annular space 18 from which a plurality of axial throughflow openings 13 pass into respective axial throughflow openings 12 which are situated in an outer annular region 10 of the pusher floor device 5 in the region of the filter cakes 14, 15. During the reciprocal axial movement of the pusher floor device 5, mixture 17 is fed radially into the region between the forward-drawn cover rim and the pusher floor proper and further accelerated, over the friction on the walls, into an annular space 18, in which are provided baffles in the form of pockets 28, in order to bring the mixture in the pockets 28 to peripheral velocity. Between the cover 29 and the pockets 28 are recessed the radial feeding openings 13 through which the mixture 17 gets into the axial throughflow openings 12, which interconnect the front and rear space of the sieve drum 6. The sieve drum is composed in its jacket of a sieve 7 which is held by a perforated support cylinder 8. The mixture 17 tries to distribute itself in both directions axially and in the peripheral direction at the outlet from the throughflow openings 12, while on the side in the direction of the ejection movement 27 is situated the deposited filter cake 14 being pushed out, whereas on the opposite side an empty space 16 is created into which the mixture 17 may flow to separate the liquid portion. When the movement is reversed, the solid matter portion, which has in the meantime been deposited, is pushed out with the adjacent filter cake by less than one stroke length, and solid matter portion is deposited on the rear side.

FIG. 4 shows axial throughflow openings 12 which occupy a whole annular gap section 30 in order to obtain good level equalization for the filter cakes 14, 15 also in the peripheral direction. The pockets 28 are offset forwards in the direction 32 of rotation to cause a more uniform flow into the annular gap cross-section 30. The cover 29 is supported in the pusher floor proper in a recess 31 with a shoulder which forms at the same time in the region of the pockets 28 a limitation for the radial feeding openings 13. In the region of the axial throughflow openings 12 are on both sides provided recesses into which may be inserted, according to FIG. 9, wearing rings 38.

Figure 6:
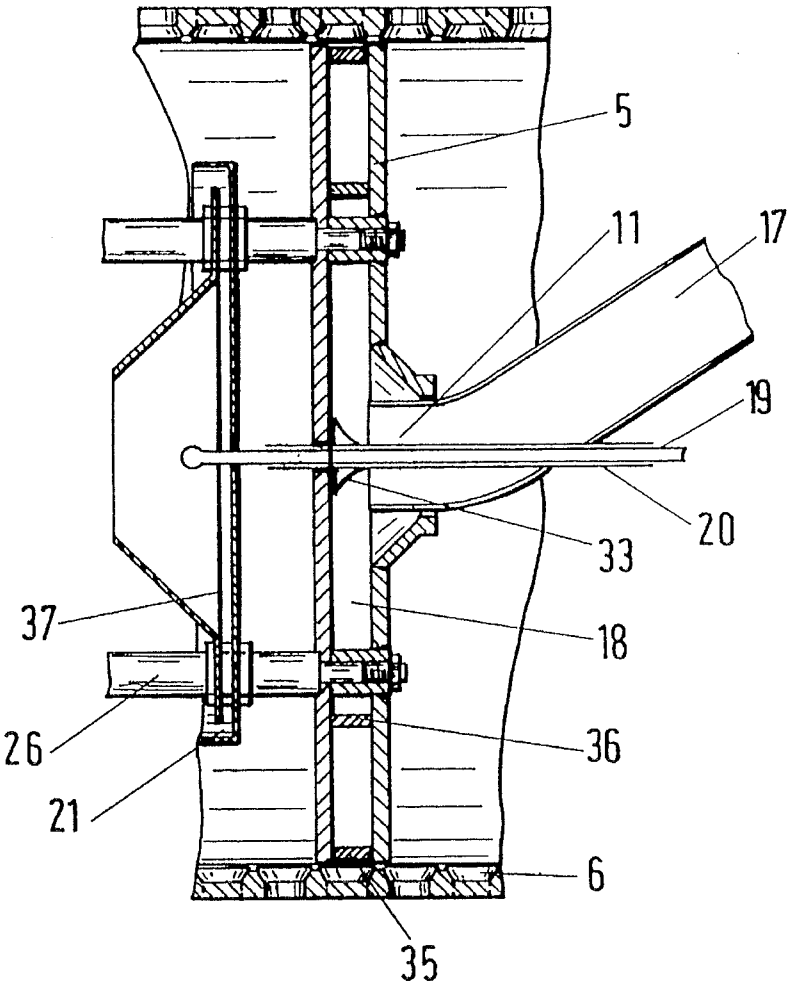
FIG. 6 shows diagrammatically a longitudinal section through a pusher floor device according to FIG. 5 having an axially displaceable annular channel for capturing and distributing washing liquid.
Figure 5:
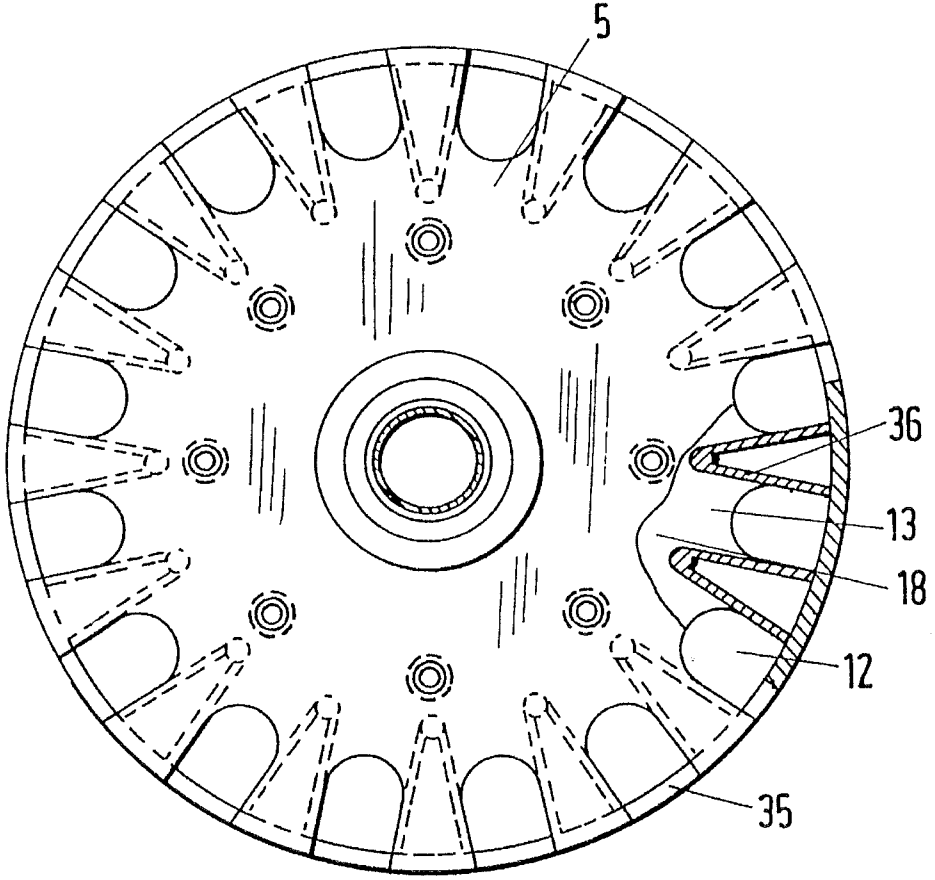
FIG. 5 shows diagrammatically a front elevation of a double-walled pusher floor device which has a closure strip to a sieve drum.

FIGS. 5 and 6 illustrate a double-walled pusher floor device 5 having a welded construction in which the feeding unit 11 feeds the mixture 17 in the middle of a hollow pusher floor. Both the side walls are at their peripheries interconnected by a closure strip 35. The axial throughflow openings 12 are separated from each other by spacers 36, while the spacers 36 at the same time form from the annular space 18 the radial feeding openings 13. On the rods 26 may be fixed in different axial positions a funnel-shaped annular channel 37 for washing liquid **21*a*, in order to capture and distribute in the rear space of the sieve drum 6 the washing liquid supplied through the pipe 19 and the support pipe 20. Through a pipe 19, which extends further in the axial direction, rinsing liquid 21*b* may be additionally supplied into the rear space of the sieve drum 6 to remove the filter cake 14** and to clean the sieve lining.

Figure 8:
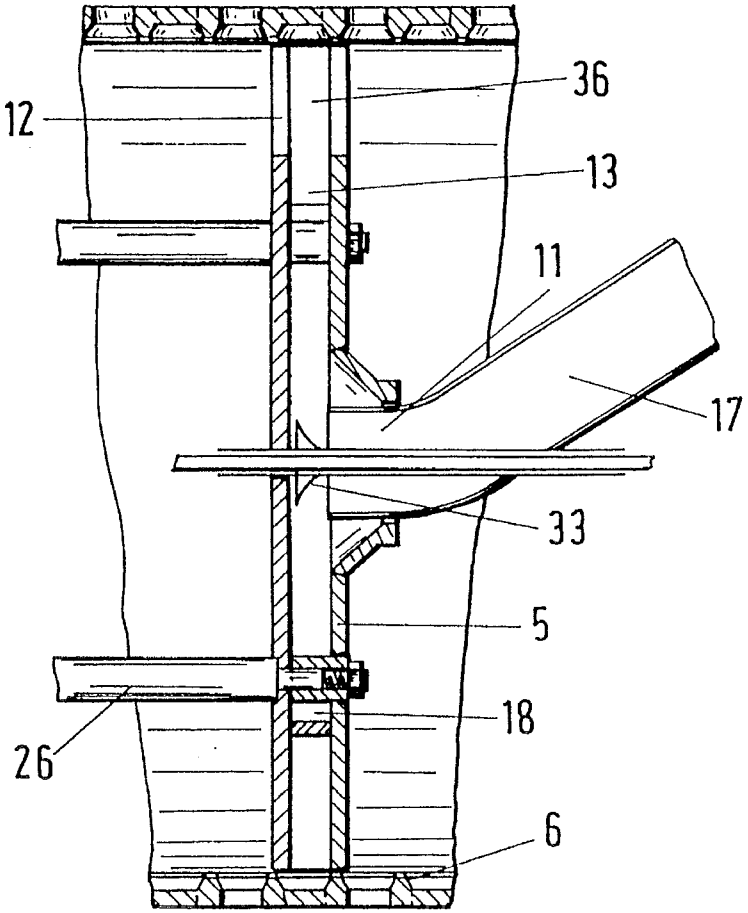
FIG. 8 shows diagrammatically a longitudinal section through a pusher floor device according to FIG. 7.
Figure 7:
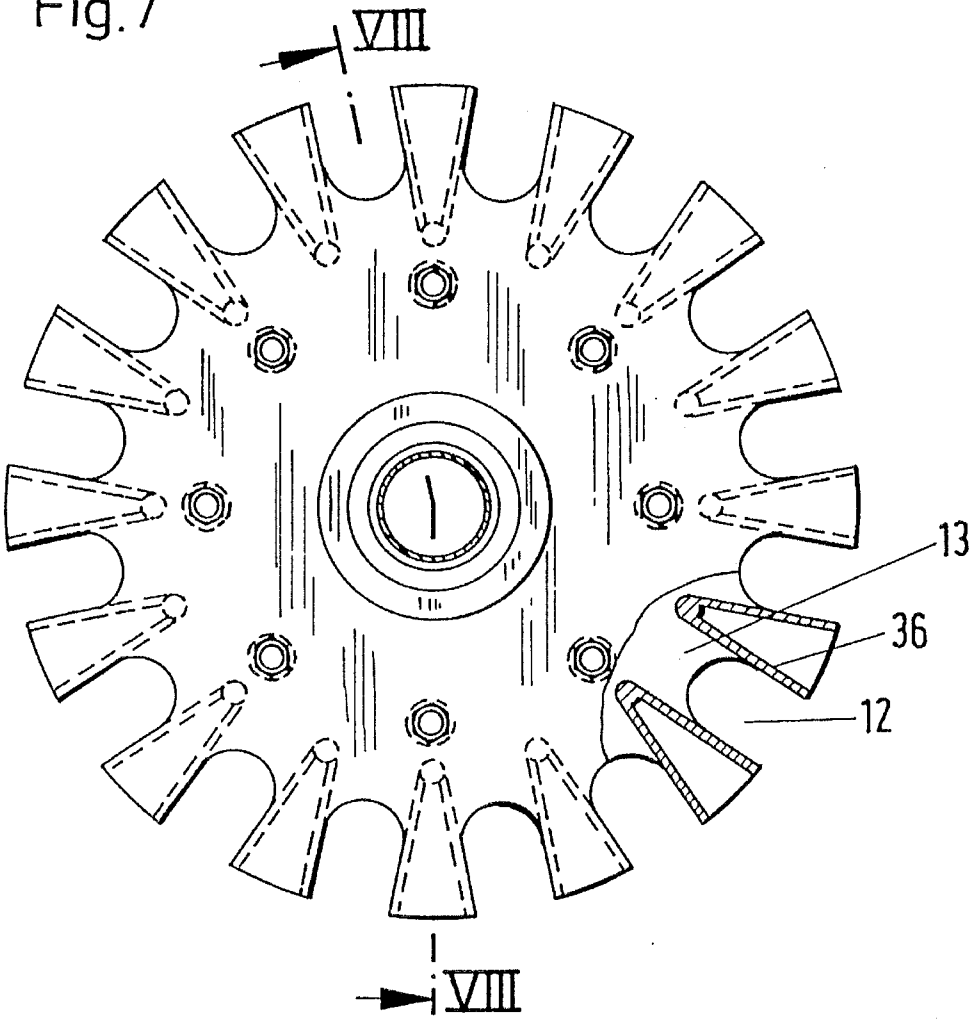
FIG. 7 shows diagrammatically a front elevation of a double-walled pusher floor device whose axial throughflow openings open towards the sieve drum.

FIGS. 7 and 8 show a welded construction in which the outer closure strip is left out. The axial throughflow openings 12 open towards the sieve, so that care must be taken that the spacing between two spacers 36 is sufficiently small to obtain during pushing-out a continuous annular shape of the filter cakes 14, 15.

Figure 9:
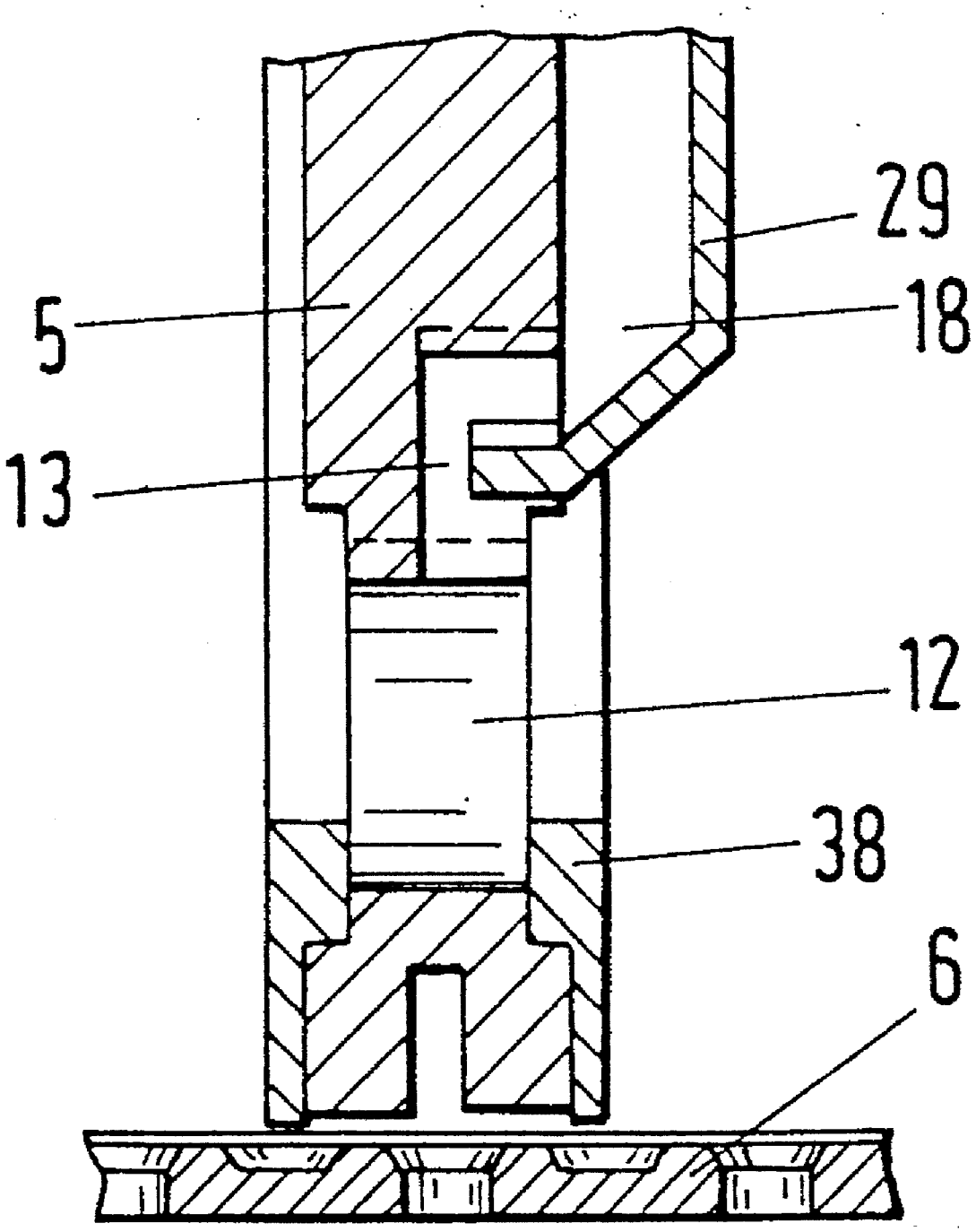
FIG. 9 shows a cut-out of the pusher floor proper according to FIG. 4 in which wearing rings are used.

FIG. 9 shows a cut-out of the pusher floor 5 on which are positioned wearing rings 38. The wearing rings may postpone the wear of the throughflow openings 12. In addition it is possible to adapt the axial outlet height to the product properties. The wearing ring may be made in one piece or be composed of several radially displaceable segments. When it is made as displaceable segments, the radial overflow height may be continuously adjusted.

I claim:

1. A twin pusher centrifuge comprising:

a centrifuge housing;

a feeding unit for supplying a product mixture into the centrifuge housing;

a sieve drum defining a lengthwise axis, first and second oppositely located ends and an inner wall, the sieve drum being rotatably coupled within the housing for separating the product mixture into liquid and solid matter, the solid matter being directed radially outward to form filter cakes on the inner wall of the sieve drum; and a pusher floor device positioned within the sieve drum for reciprocal axial movement therein and having an outer annular region facing the inner wall of the sieve drum, the outer annular region having opposite sides for alternatively pushing at least a portion of the solid matter in the filter cakes through the oppositely located ends of the seive drum to thereby discharge the portion of the solid matter from the seive drum, the pusher floor device including a plurality of axial throughflow openings communicating with the opposing sides of the outer annular region and a plurality of radial feed openings in communication with the feeding unit for directing the solid matter of the product mixture through the axial throughflow openings to one of the opposing sides of the outer annular region.

2. The centrifuge of claim 1 wherein the feeding unit has an opening aligned with the axis of the sieve drum to supply the product mixture into a center portion of the sieve drum, the radial feed openings branching off in a radial direction from the center portion.

3. The centrifuge of claim 2 wherein the pusher wall device comprises first and second walls defining an annular space therebetween, the annular space being in communication with the feeding unit and the radial feed openings.

4. The centrifuge of claim 3 wherein the first and second walls are coupled together by a transverse closure strip in the outer annular region.

5. The centrifuge of claim 2 wherein the pusher wall device comprises a main wall and a cover positioned to form an annular space therebetween, the annular space being in communication with the feeding unit and the radial feed openings.

6. The centrifuge of claim 1 wherein the pusher floor device further includes a stationary support pipe and an axially displaceable pipe within the support pipe for supplying rinsing liquid into the sieve drum.

7. The centrifuge of claim 6 wherein the stationary support pipe extends through the feeding unit and includes at least one deflector for directing the product mixture radially outward towards the radial feed openings.

8. The centrifuge of claim 6 further including an axially displaceable annular channel parallel to the pusher floor device within the housing for receiving and distributing the rinsing liquid from the axially displaceable pipe.

9. The centrifuge of claim 1 wherein the axial throughflow openings are sections of an annular gap in the pusher floor device.

10. The centrifuge of claim 1 further including a plurality of wearing rings in the outer annular region of the pusher wall device for adjusting an axial outlet height of the axial throughflow openings.

* * * * *